US006153136A

United States Patent [19]

Collier et al.

[11] Patent Number: 6,153,136

[45] Date of Patent: Nov. 28, 2000

[54] PROCESS FOR MANUFACTURING CELLULOSIC MICROFIBERS

[75] Inventors: John R. Collier; Ioan I. Negulescu; Billie J. Collier, all of Baton Rouge, La.

[73] Assignee: Board of Supervisors of Louisiana State University and Agricultural and Mechanical College, Baton Rouge, La.

[21] Appl. No.: 09/172,449

[22] Filed: Oct. 14, 1998

Related U.S. Application Data

[60] Provisional application No. 60/108,163, Oct. 17, 1997.

[51] Int. Cl.[7] ..... D01D 5/04; D01F 2/02; D02G 3/00

[52] U.S. Cl. ..... 264/103; 264/205

[58] Field of Search ..... 264/103, 205

[56] References Cited

U.S. PATENT DOCUMENTS

| | | | |
|---|---|---|---|
| 3,097,991 | 7/1963 | Miller et al. . | |
| 3,099,067 | 7/1963 | Merriam et al. . | |
| 3,382,305 | 5/1968 | Breen . | |
| 4,053,270 | 10/1977 | Collier et al. . | |
| 4,350,006 | 9/1982 | Okamoto et al. . | |
| 4,680,156 | 7/1987 | Collier . | |
| 4,787,474 | 11/1988 | Yamamoto et al. . | |
| 5,357,784 | 10/1994 | Collier . | |
| 5,436,066 | 7/1995 | Chen | 442/398 |
| 5,863,652 | 1/1999 | Matsumura et al. | 428/359 |

OTHER PUBLICATIONS

Cogswell, F., "Measuring the extensional rheology of polymer melts," *Trans. Soc. Rheol.*, vol. 16, pp. 383–403 (1972).

Dufresne, A. et al., "Mechanical Behavior of Sheets Prepared from Sugar Beet Cellulose Microfibrils," *J. Appl. Polm. Sci.*, vol. 61, pp. 1185–1193 (1997).

Hongu, T. et al., *New Fibers*, pp. 30–34, Ellis Horwood Series Polymer Science and Technology (1990).

Hongu, T. et al., *New Fibers*, pp. 54–65, Ellis Horwood Series in Polymer Science and Technology (1990).

Kerr, P., "Lyocell fibre: Reversing the Decline of Cellulosics," *Technical Textiles*, vol. 3, pp. 18–23 (1994).

Mortimer, S. et al., "Methods for Reducing the Tendency of Lyocell Fibers to Fibrillate," *J. Appl. Polym. Sci.*, vol. 60, pp. 305–316 (1996).

"Murata: Spinning Microfiber Yarns on the MJS System," *Textile World*, vol. 144, pp. 42–48 (Jan.–Jun. 1996).

Nicolai, M. et al., "Textile Crosslinking Reactions to Reduce the Fibrillation Tendency of Lyocell Fibers," *Textile Res. J.*, vol. 66, pp. 575–580 (1996).

Robeson, L. et al., "Microfiber Formation: Immiscible Polymer Blends Involving Thermoplastic Poly(vinyl alcohol) as an Extractable Matrix," *J. Appl. Polymer Sci.*, vol. 52, pp. 1837–1846 (1994).

Simionescu, C. et al., "Romanian Wood Chemistry," RSR Academy Publishing House, Bucharest (1973) [Single–page excerpt, Eng. translation].

Tsebrenko, M. et al., "Mechanism of Fibrillation in the Flow of Molten Polymer Mixures," *Polymer*, vol. 17, pp. 831–834 (1976).

Warner, S., "Fiber Cross–Section and Linear Density," Chapter 5 (pp. 80–98)*Fiber Science* (1995).

U.S. Patent Application Serial No. 09/172,056 (Filed on Oct. 14, 1998).

*Primary Examiner*—Leo B. Tentoni
*Attorney, Agent, or Firm*—John H. Runnels

[57] ABSTRACT

Microfibers have been manufactured from dissolved cellulose, from which threads, yarns, and fabrics can be made. These cellulosic microfibers may be used to produce fabrics with the very soft feel that is characteristic of microfiber fabrics, and the water absorbency and comfort of cellulosic fabrics. Furthermore, since the microfiber diameter may be 2 $\mu$m or smaller (about the same size as dust particles and small oily droplets), these fabrics have an exceptional ability to remove dust and oil droplets from surfaces and gas streams, and are therefore useful in filter media. The novel microfibers may be manufactured by the continuous flow of dissolved cellulose through a converging die. Imposing orientation in the incipient microfiber prior to or during crystallization of the cellulose produces continuous fibers of substantial aspect ratio, without significant entanglement.

5 Claims, No Drawings

PROCESS FOR MANUFACTURING CELLULOSIC MICROFIBERS

The benefit of the Oct. 17, 1997 filing date of provisional application 60/108,163 is claimed under 35 U.S.C. § 119(e).

This invention pertains to cellulosic microfibers useful in making threads, yarns, and fabrics; and to methods for manufacturing cellulosic microfibers useful in making threads, yarns, and fabrics.

Microfibers are fibers that are suitable for use in textiles, and that have a very small diameter. The only microfibers currently available commercially are certain polyester microfibers. Nylon microfibers have also been reported, but are not commercially available. Microfibers have a much softer hand (or feel) than ordinary fibers of identical composition, because the diameter of microfibers is an order of magnitude smaller. Fabrics made from polyester microfibers feel like a soft brushed cotton fabric to the hand, and have the flexibility of fine silk. However, neither polyester nor nylon microfibers have the water absorbency of virgin or regenerated cellulosic fibers, and they therefore lack the comfort of fabrics made from cellulose. Fabric made of cellulosic microfibers, if available, would have the very soft feel of polyester microfiber fabric, together with the water absorbency and comfort of other cellulosic fabrics. However, no one has previously reported cellulosic microfibers suitable for use in textiles, either natural or artificial.

(The size of fibers is defined in terms of linear density. Although there is no precise cut-off as to what constitutes a "microfiber," the term "microfiber" may be considered to refer to a fiber about 1 decitex (1 decitex=1 g/10,000 m) or less. A microfiber of cellulose would thus be about 9 $\mu$m in diameter or less, while the diameter of a microfiber of less-dense polyester is about 10 $\mu$m: in round numbers, a microfiber may thus be considered as a fiber having a diameter about 10 $\mu$m or less.)

Prior methods for making polyester or nylon microfibers are based on spinning "sea and island" type composite fibers. The "islands" are the microfibers embedded in a "sea" of the second component, generally another polymer that is incompatible (immiscible) with the first under the spinning conditions. This second component is removable by a combination of mechanical action and solvation. This second component is generally not removed until the microfibers have been converted to yarns or fabrics in order to protect the microfibers. Direct production of microfibers, with subsequent drawing of multiple individual microfibers external to the channel, would cause an unacceptable level of line breaks. See generally S. Warner, "Fiber Cross-Section and Linear Density," Chapter 5 (pp. 80–98) *Fiber Science* (1995)

P. Kerr, "Lyocell fibre: Reversing the Decline of Cellulosics," *Technical Textiles,* vol. 3, pp. 18–23 (1994) discloses the use of N-methyl morpholine-N oxide (NMMO.$H_2O$) as a solvent for cellulose, and the use of the resulting solutions to spin cellulosic "lyocell" fibers as small as 1.1 decitex. It was reported that the lyocell fibers tended to fibrillate (i.e. break under stress into smaller pieces on the surface). These fragments, even if detached, would not be useful in textiles because they are too short and tangled.

S. Mortimer et al., "Methods for Reducing the Tendency of Lyocell Fibers to Fibrillate," *J. Appl. Polym. Sci.,* vol. 60, pp. 305–316 (1996) discloses methods for modifying process conditions to increase or decrease fibrillation in lyocell fibers. See also M. Nicolai et al., "Textile Crosslinking Reactions to Reduce the Fibrillation Tendency of Lyocell Fibers," *Textile Res. J.,* vol. 66, pp. 575–580 (1996), which discloses the use of certain crosslinking agents with lyocell fibers for the same purpose.

A. Dufresne et al., "Mechanical Behavior of Sheets Prepared from Sugar Beet Cellulose Microfibrils," *J. Appl. Polym. Sci.,* vol. 61, pp. 1185–1193 (1997) discloses the preparation of and properties of certain films prepared from sugar beet fiber by-product.

L. Robeson et al., "Microfiber Formation: Immiscible Polymer Blends Involving Thermoplastic Poly(vinyl alcohol) as an Extractable Matrix, " *J. Appl. Polymer Sci.,* vol. 52, pp. 1837–1846 (1994) discloses a "sea and island" method for producing microfibers from polypropylene, polystyrene, polyester, and other synthetic polymers by melt extrusion with poly(vinyl alcohol).

U.S. Pat. No. 3,097,991 discloses feltable paper forming fibers, prepared by the melt extrusion of mutually incompatible thermoplastic materials, such as polyamides, polyesters, polyurethanes, and vinyl and acrylic polymers. The resulting monofilaments were reported to have diameters in a range 0.2 to 100 microns and lengths between 1/32 and ½ inch. See also U.S. Pat. No. 3,099,067, disclosing the formation by similar means of various synthetic fibers (but specifically excluding regenerated cellulosic fibers), having a small cross section (0.1 to 5.0 micron diameter).

M. Tsebrenko et al., "Mechanism of Fibrillation in the Flow of Molten Polymer Mixtures," *Polymer,* vol. 17, pp. 831–834 (1976) discloses experiments supporting the conclusion that ultra-fine fibrils of one of two incompatible polymers formed in flow of melts of the two polymers through an extrusion orifice occur in the entrance to the orifice, rather than in the extrusion duct or in the exit.

"Murata: Spinning Microfiber Yarns on the MJS System," *Textile World,* vol. 144, pp. 42–48 (Jan.–June 1996) discloses the use of a commercial spinning machine to form yarn from microfibers of polyester.

M. Isaacs et al., "Race Is on to Find New Uses for Microfibers," *Textile World,* vol. 144, pp. 45–48 and 73–74 (August 1994) discusses practical uses for various currently commercially available microfibers, none of which are cellulosic.

T. Hongu et al., *New Fibers,* pp. 30–34, Ellis Horwood Series in Polymer Science and Technology (1990) disclose the fine structure of certain polyester fibers.

T. Hongu et al., *New Fibers,* pp. 55–66, Ellis Horwood Series in Polymer Science and Technology (1990) disclose that microfibers can be produced by "sea and island" bicomponent extrusion and fiber spinning of nylon (polyamide) and polyester, polyester and polystyrene, or nylon and polystyrene, as each pair of components is immiscible at spinning conditions. After spinning, the two phases are separated from one another, and one may be removed in a solvent. Polyester microfibers partially separated from one another in a fabric may be used in cloths for cleaning automobiles or microchips. See also U.S. Pat. Nos. 3,382,305, 4,350,006, and 4,784,474.

The "sea and island" approach has not been used to produce cellulose microfibers, presumably because that approach either forms a single phase of the two polymers in the melt state prior to extrusion, or mechanically combines two melt streams. Such techniques may not be used with cellulose, because cellulose degrades on heating before reaching the pertinent melting points.

U.S. Pat. No. 5,357,784 discloses a method and apparatus for measuring elongational viscosity in a hyperbolic or semi-hyperbolic die geometry with lubricated flow, by measurements of pressure drop and flow rate data.

U.S. Pat. No. 4,680,156 discloses a composite extrusion, such as a fiber, film or ribbon, having an inner core and an outer sheath, formed by melt transformation coextrusion.

The inner core was transformed to a molecularly oriented polymer capable of being rigidified by imposition of a temperature gradient. The sheath was made of a polymer whose molecules were generally not oriented. See also U.S. Pat. No. 4,053,270.

U.S. Pat. No. 4,350,006 discloses sea-and-island type polymer filaments, formed from the continuous discharge of fluids of two different polymers through a single orifice, preferably by melt spinning. Examples of the two-polymer combinations included polyethylene terephthalate with nylon 6, and polyacrylonitrile with cellulose acetate. Unlike cellulose, cellulose acetate may be melted without decomposing.

Certain East European poplar trees produce fine cellulosic fibers, but these fibers are not suitable for use in textiles, because the fibers form individual filaments as opposed to packets of microfibers, and individual fibers are prone to break when subjected to the mechanical action necessary to form yarns. The average length of these fibers is 8 mm±1 mm. The (non-uniform) fiber thickness at one end is 18 μm, decreasing to 6 μm at the other end, with an average thickness of 10 μm±2 μm. These fuzzy fibers have a much lower cellulose content than do bagasse, sugar cane rind, kenaf, etc., typically comprising only 59 to 65% cellulose. The poplar fuzzy fibers are hollow (i.e. have a lumina); near this lumina the cellulose is oriented parallel to the fiber axis; but the cellulose is not oriented near the outer surface of the fibers. See C. Simionescu et al., *Chimia lemnului in Romania. Plopul si salcia.* (Translation: Chemistry of Woods from Romania. The Poplar and Willow), Romanian Academy Publishing House, Bucharest, Romania (1975).

All previously reported synthetic cellulosic fibers have had diameters 10 to 30 μm or larger. See, e.g., R. W. Moncrieff, *Man-Made Fibers,* p. 26 (6th ed. 1975).

We have discovered novel microfibers manufactured from dissolved cellulose, from which threads, yarns, and fabrics can be made; as well as a novel process for producing these microfibers.

These cellulosic microfibers may be used to produce fabrics with novel qualities—including the very soft feel that is characteristic of microfiber fabrics, combined with the water absorbency and comfort of cellulosic fabrics, a combination that has not previously been produced. Furthermore, since the microfiber diameter may be 2 μm or smaller (about the same size as dust particles and small oily droplets), these fabrics have an exceptional ability to remove dust and oil droplets from surfaces and gas streams, and are therefore useful in filter media. This removal ability is enhanced in comparison to polyester microfiber fabrics, because cellulose is considerably more hydrophilic than polyester. If the ability to attract oil and dust is undesirable in a particular application, the fibers may be treated with any of several anti-static agents known in the art.

The novel process produces long microfibers that are useful in textiles. A preferred method for producing the novel microfibers of suitable length is continuous flow of dissolved cellulose through a hyperbolic or semi-hyperbolic die. By imposing orientation in the incipient microfiber prior to or during crystallization of the cellulose, continuous fibers are produced of substantial aspect ratio, without significant entanglement.

Cellulosic microfibers that have been made to date show a number of distinctions from any previously known natural or synthetic cellulosic fiber. These differences include a small diameter (10 μm, 9 μm, 8 μm, 7 μm, 6 μm, 5 μm, 4 μm, 3 μm, 2 μm, 1 μm, 0.75 μm, 0.5 μm, 0.2 μm, 0.1 μm, or even smaller), and an essentially continuous surface (as opposed to a layered skin structure). The microfibers preferably have a solid interior, although a hollow interior could be desirable in some applications. By contrast, most natural cellulosic fibers are hollow and have a layered skin structure, since plant nutrients are transported through their interior. For example, the characteristic 20 μm or larger diameter, "flattened fire hose" appearance of cotton fibers results from their hollow interior. Many natural fibers have a multiple-layer wall structure similar to that of wood fibers, in which the cellulose molecules in each of the layers are oriented differently.

The novel fibers comprise at least 80% cellulose, preferably at least 95% cellulose. As discussed below, in some applications it may be desirable to have small amounts of other substances such as lignin.

One embodiment of this invention employed the relatively new, environmentally-friendly solvent for cellulose, $NMMO.H_2O$. Manufactured cellulose fibers produced with this solvent system (or other solutions of cellulose) are sometimes generically referred to as "lyocell," in contrast to fibers such as rayon that are manufactured from solutions of a cellulose derivative (e.g., viscose rayon is manufactured from a xanthated cellulose dissolved in an aqueous sodium hydroxide solution). Although not preferred, other possible solvents for the cellulose include other amine oxides and dimethyl formamide/lithium chloride.

In prototype embodiments, we have formed cellulose solutions using cellulose sources such as sugar cane rind, sugar cane bagasse, kenaf rind, recycled cotton, and dissolving pulp (the last is the starting material in forming lyocell and rayon fibers). The solvent has been $NMMO.OH_2O$, forming lyocell solutions ranging from 2% to 20% cellulose by weight. The starting solvent was a 1:1 molar solution of NMMO and $H_2O$. The lyocell solvent need not be exactly the monohydrate, but cellulose seems to more soluble in the monohydrate than in other concentrations. The solutions were made in a rotovap unit by adding cellulose to the starting solvent to form a slurry. The slurry was progressively transformed to a solution by slowly rotating it in a flask in a water bath (near boiling) while removing water by pulling a slight vacuum. The cellulose solution formed a liquid crystalline state in the lyocell solvent system at the temperature and concentrations used. The solution was then loaded into the reservoir of a capillary rheometer, and forced through a semi-hyperbolic converging die at a temperature between 80° and 110° C. (A high shear device is often preferred in forming lyocell solutions, but was not available in our laboratories.)

Once in a liquid crystalline state, the solution is transformed to a two-phase regime by the application of stress, preferably induced by flow through a converging die. One of the two phases contains oriented cellulose microfibers (with perhaps some retained solvent), and the other phase is primarily solvent (with perhaps some retained cellulose). The entropic effect of orientation drives the phase separation. Once the phase separation has occurred, it is difficult to transform the solution back into a single phase. The extrudate then exits the die and cools (or is diluted, e.g. in water, which will also cause precipitation of the cellulose) before significant swelling and loss of orientation can occur. By separating a cellulose-rich phase from solution in the die, only a fraction of the cross-sectional area of the die is occupied by the microfibers; the remainder is essentially a lubricating solvent rich phase, which inhibits plugging of the die.

Converging flow is used to induce both orientation and the subsequent flow-induced phase transition. A semi-hyperbolically converging die (discussed further below) is preferred for such flow, but is not required. For example, a linearly converging die has also been successfully used, although results with semi-hyperbolic convergence were superior.

If the reservoir temperature is above 110° C., the solution is thereafter transformed to a lyotropic state (i.e., an ordered liquid crystalline state), for example by reducing the temperature. The pressure drop and volumetric flow rate data in the semi-hyperbolic die were measured and analyzed to calculate the effective elongational viscosity (as described in greater detail in John R. Collier, "Elongational Rheometer and On-Line Process Controller," patent application Ser. No. 09/172,056, filed Oct. 14, 1998.) We have also made shearing viscosity measurements on the same solutions. The extrudates have been viewed in optical and scanning electron microscopes as extruded, after water treatment, and after breaking mechanical treatment. We have demonstrated the presence of microfibers in the extrudates from the semi-hyperbolic dies. Microfibers have been separated from the extrudate by mechanical action. Threads, yarns, and fabrics will be made from these microfibers using otherwise conventional techniques.

Forcing the solution through a semi-hyperbolic converging die provokes microfiber formation, orients the microfibers, causes phase separation of the microfibers from the solvent, and may crystallize and precipitate the cellulose. The lower viscosity, solvent-rich and cellulose-poor phase lubricated the higher viscosity, cellulose-rich phase during passage through the die. The lubrication prevented clogging of the die, as can otherwise occur in flow-induced crystallization of polymer melts. The semi-hyperbolically converging die not only induced orientation inside the die, but did so at a constant elongational strain rate, thereby enabling high spinning rates. Semi-hyperbolic convergence of the flow is preferred, because semi-hyperbolic flow induces a constant strain and is therefore less likely to introduce flow instabilities than linear convergence, which causes a variable and increasing strain rate. With a more gradual and controlled increase in velocity and deformation, ideally a nearly constant elongational strain rate, the system should be more stable. Both the strain and the strain rate have an important effect; strain is indicative of the orientation developed by imposing deformation, but because the material is still fluid, some of the orientation can relax while still flowing. At higher strain rates more orientation is retained since less relaxation can occur; lower strain rates achieving the same strain would allow greater relaxation. If a varying strain rate were imposed, orientation would still develop, but flow instabilities would be more likely. In elongational flow, the strain rate is closely linked to the velocity gradient: a constant strain rate implies a controlled increase in velocity, namely a constant acceleration of the fluid.

Even without crystallization of the cellulose, the flow-induced phase separation effectively imposed a high degree of orientation on the extruded fibers. The entropy-driven phase separation due to the chain alignment that develops during orientation of the cellulose solution causes the extrudate to maintain most of its orientation, as there is no sufficient driving force to re-dissolve the cellulose.

The cellulose could not readily re-dissolve before the spun fiber was cooled, and was then optionally passed through a water bath to further inhibit re-dissolution of the cellulose, and to enhance the cellulose content of the microfibers by dissolving NMMO in water.

An additional benefit to orienting and forming the microfibers inside a semi-hyperbolically converging channel is that breakage of the microfibers is greatly reduced compared to the breakage of commercially-prepared polyester microfibers. Flow through the semi-hyperbolically converging channel forms and orients the fibers by pushing rather than by pulling, so that the fibers have sufficient strength to exit the die without substantial breakage.

Separation of the cellulose-rich phase from the solvent-rich phase may depend in part on the amount of lignin in the solution, which can be controlled as desired by controlling the amount of lignin removed from the cellulose source, which may for example be wood pulp, sugarcane bagasse, or kenaf. Lignin, a natural adhesive found in many cellulosic materials, is also soluble to a limited extent in NMMO.$H_2O$; therefore, the amount of lignin remaining with the cellulose will probably alter the solution thermodynamics and kinetics. The retained lignin may also affect the size of the phase separated regions, and therefore the size of the resulting microfibers. Future experiments will better define the effect of lignin.

Electron micrographs of microfibers produced by the novel process show that those microfibers can have a diameter of 0.5 $\mu$m or smaller, well within the range of microfibers and even within the range that is sometimes defined as ultrafine fibers or ultrafibers. Ultrafine fibers of cellulose, defined to be 0.01 denier or less, would have a diameter of about 1 $\mu$m or less; therefore the observed 0.5 $\mu$m diameter fibers are ultrafine fibers. Bundles of 0.5 $\mu$m diameter cellulosic microfibers seen in the electron micrographs typically had a diameter of about 10 $\mu$m; the bundles were therefore essentially microfibers themselves. By appropriate adjustment of the processing conditions, die geometry, and amount of lignin present it will be possible to form bundles of 0.5 $\mu$m diameter cellulosic microfibers with diameters less than 10 $\mu$m if desired. For example, micromachined spinnerets (formed, for example, by a LIGA or modified LIGA process) could be used to make individual microfibers of 0.5 $\mu$m or smaller diameter.

In an alternative embodiment, microfibers are simultaneously formed and oriented while passing through an array of converging spinneret holes. For example, using a 15% solution of cellulose in a lyocell solvent, a 2 $\mu$m exit diameter hole will produce a microfiber having a diameter of about 0.5 $\mu$m, which is the same as the diameter of microfibers we have observed in 100 $\mu$m diameter bundles after passing through a 600 $\mu$m diameter hole. The microfibers exiting the spinneret array may be directly combined into a yarn, without the need for further orientation.

Theoretical Considerations

Without wishing to be bound by the following theory, the following discussion presents the theory that is believed to underlie the formation of microfibers in the novel process. Unless otherwise indicated, this theoretical analysis applies both to skinless flow and to the core material in skin/core lubricated flow conditions. The distinction between skinless flow and the core of skin/core flow is more important in elongational rheological measurements, but is also pertinent to the formation of microfibers.

When phase separation occurs during the flow of the cellulose in a solvent such as NMMO.$H_2O$, the solvent-rich phase becomes a lubricating layer, because this lower-viscosity phase tends to migrate to the high-shear region near the die interface. Because the skin layer has a viscosity substantially lower than the viscosity of the core, the shearing gradient from the die wall is essentially confined to the skin, producing an essentially elongational flow pattern in the core.

In a preferred embodiment, the die's convergence geometry is chosen to force a constant elongational strain rate, $\dot{\epsilon}$, in the core. Although other die geometries are possible, two preferred geometries, the geometries that have been used in prototype experiments, are the hyperbolic slit and the semi-hyperbolic cone. A hyperbolic die is one for which a longitudinal line reflected onto the surface would trace out a hyperbola. In what is referred to as a "semi-hyperbolic cone" the relationship between the radius of the cone's inside surface, R, and the longitudinal direction, z, is $R^2z=C_1$, where $C_1$ is a constant. A hyperbolic slit has a constant width, W, along the y-axis, and its width measured along the x-axis is given by $Xz=C_2$, where $C_2$ is a constant. For the hyperbolic slit, the semi-hyperbolic cone, and other "semi-hyperbolic" surfaces, the area perpendicular to the centerline of flow is directly proportional to the reciprocal of the centerline distance from an origin, i.e. the cross-sectional area of flow is inversely proportional to the centerline distance. The semi-hyperbolic cone is preferred. The hyperbolic slit used in a prototype had a specially milled die insert, while the semi-hyperbolic cone used an ACER capillary rheometer with an electrodischarge-machined, semi-hyperbolically-converging capillary to replace the rheometer's normal capillary. Pressure drops and volumetric flow rates were measured in all cases.

The die shapes were chosen so that the interface between the polymer melt or solution and the die wall was a stream tube, i.e. a set of streamlines forming a two dimensional surface, with each streamline in that surface experiencing the same conditions, and having the same value of the stream function $\psi$. The stream function must satisfy the continuity equation. The potential function, $\Phi$, must be orthogonal to $\psi$ and satisfy the irrotationality equation. Constant values of the potential function define surfaces of constant driving force, i.e. constant pressure surfaces. As shown below semi-hyperbolic stream functions (and potential functions) satisfy these conditions for both the converging slit and converging cone geometries.

Hyperbolic Slit

For the hyperbolic slit in Cartesian coordinates the stream function and potential functions are respectively:

$$\Psi = -\dot{\varepsilon}xz$$

$$\Phi = \frac{\dot{\varepsilon}}{2}(x^2 - z^2)$$

The Cauchy-Riemann conditions and velocity gradients are:

$$v_z = -\frac{\partial\Psi}{\partial x} = -\frac{\partial\Phi}{\partial z},\ v_x = \frac{\partial\Psi}{\partial z} = -\frac{\partial\Phi}{\partial x}$$

The non-zero velocity gradients are:

$$\frac{\partial v_z}{\partial z} = \dot{\varepsilon},\ \frac{\partial v_x}{\partial x} = -\dot{\varepsilon}$$

Semi-hyperbolic Cone

For the semi-hyperbolic cone in Cartesian coordinates, the stream function and potential functions are respectively:

$$\Psi = -\frac{\dot{\varepsilon}}{2}r^2z$$

$$\Phi = \dot{\varepsilon}\left(\frac{r^2}{4} - \frac{z^2}{2}\right)$$

The Cauchy-Riemann conditions and velocity gradients are:

$$v_z = -\frac{1}{r}\frac{\partial\Psi}{\partial r} = -\frac{\partial\Phi}{\partial z},\ v_r = \frac{1}{r}\frac{\partial\Psi}{\partial z} = -\frac{\partial\Phi}{\partial r}$$

The non-zero velocity gradients are:

$$\frac{\partial v_z}{\partial z} = \dot{\varepsilon},\ \frac{1}{r}\frac{\partial(r\,v_r)}{\partial r} = -\dot{\varepsilon}$$

The lyocell solution begins in a skinless flow regime, but as the cellulose or cellulose-rich phase separates from the solvent-rich phase, the solvent-rich phase preferentially concentrates near the rigid boundary due to the energy minimization principle (i.e., multiple-phase systems tend to self-lubricate by having the lower viscosity phase migrate to the shearing surface to minimize resistance to flow). The inherent driving force towards lubrication also aids in forming and retaining microfibers as it is also a driving force for phase separation. The basic equations describing the flow are the scalar equations of continuity (i.e., mass balance) and a form of energy balance expressed in terms of enthalpy per unit mass, $\hat{H}$; and the first order tensor (i.e. vector) momentum balance. Mass, momentum, and energy are each conserved. These relations expressed in tensor notation are:

$$\frac{D\rho}{Dt} = -\rho(\nabla\cdot v) \quad \text{Continuity (Mass Balance)}$$

$$\rho\frac{D}{Dt}v = -(\nabla p) - [\nabla\cdot\tau] + \rho g \quad \text{Momentum Balance}$$

$$\rho\frac{D}{Dt}(\hat{H}) = -(\nabla\cdot q) - (\tau:\nabla v) - \frac{DP}{Dt} \quad \text{Energy Balance}$$

where $\tau$, a second order tensor, denotes the stress, and the first order tensor (i.e. vector) quantities v and q denote velocity and energy flux, respectively. The body force term, g, is discussed in greater detail below; it is a first order tensor, which was found to represent primarily the force necessary to orient the material; this term would also include a gravitational component if the latter were significant. The first order tensor operator $\nabla$ denotes the gradient. The scalar terms P, $\rho$, and $\hat{H}$ are the pressure, density, and enthalpy per unit mass, respectively.

The geometry of the hyperbolic and semi-hyperbolic dies used in prototype embodiments were chosen to cause the elongational strain rate ($\dot{\epsilon}$) to be a constant whose value is determined by the geometry and the volumetric flow rate. The only velocity gradients encountered in essentially pure elongational flow are in the flow and transverse directions. Therefore the only non-zero components of the deformation rate second order tensor $\Delta$ are the normal components. If the fluid is assumed to be incompressible, then $\nabla\cdot v=0$. Thus the components of $\Delta$ are, expressed in both Cartesian and cylindrical coordinates:

$$\Delta_{ij} = \left(\frac{\partial v_i}{\partial x_j} + \frac{\partial v_j}{\partial x_i}\right), \text{ and } \Delta_{\theta\theta} = 2\left(\frac{1}{r}\frac{\partial v_\theta}{\partial \theta} + \frac{v_r}{r}\right).$$

In Cartesian coordinates the only non-zero components are the flow and transverse components, $\nabla_{zz}$ and $\nabla_{xx}$, respectively: $\nabla_{zz}=-\nabla_{xx}=2\dot{\epsilon}$.

The corresponding non-zero components in cylindrical coordinates are $\nabla_{zz}$, $\nabla_{rr}$, and $\nabla_{\theta\theta}$; where $\nabla_{zz}$ is the flow direction; $\Delta_{zz}=-2\Delta_{rr}=-2\Delta_{\theta\theta}=2\dot{\epsilon}$. (Note that $\nabla_{\theta\theta}$ and the corresponding stress tensor component $\tau_{\theta\theta}$ are both non-zero.)

Assumptions made in this theoretical analysis, along with some implications of these assumptions, include the following. (Note that these and other assumptions in this theoretical section, which were made for purposes of simplifying the theoretical analysis, need not be rigorously satisfied in practical applications.)

1. The stress state in a fluid is uniquely determined by its strain rate state, i.e. the fluid is described by a generalized Newtonian constitutive equation (not necessarily a Newtonian fluid per se). Because the geometry dictates that the only non-zero deformation rate components are the normal components, and further that the deformation rate components are not a function of position; it follows that the only non-zero stress components are the normal components, and that the stress components are not a function of position. Thus $\nabla\cdot\tau=0$.
2. The fluid is incompressible. Therefore $\nabla\cdot v=0$.
3. The system is isothermal. Therefore $\nabla\cdot q=0$.
4. The flow is steady as a function of time. Therefore $$\frac{\partial}{\partial t} = 0.$$

5. Inertial terms are negligible, so that $v\cdot\nabla v=0$, and $$\nabla\left(\frac{v^2}{2}\right) = 0.$$

Using these assumptions the momentum balance equation implies that the body force g is equal to $\nabla$ p; i.e. in cylindrical coordinates $$g_z = \frac{\partial P}{\partial z} \text{ and } g_r = \frac{\partial P}{\partial r},$$

and in Cartesian coordinates $$g_z = \frac{\partial P}{\partial z} \text{ and } g_x = \frac{\partial P}{\partial x}.$$

However, even though (as discussed below) the assumption is inappropriate here, if one made the usual assumption that the body force g is attributable solely to gravity and is therefore negligible, coupled with the above assumptions, then it would follow that the pressure gradients would be zero—a conclusion that is clearly incorrect. Alternately, if it were assumed that the inertial terms are not negligible, then pressure gradients in the two geometries for the slit and semi-hyperbolic geometries would be, respectively:

$$P = P_{00} - \frac{\rho\dot{\epsilon}^2}{2}(z^2 + x^2) \text{ and } P = P_{00} - \frac{\rho\dot{\epsilon}^2}{2}\left(z^2 + \frac{r^2}{4}\right).$$

However, there are still two difficulties with these conclusions. First, the pressure gradients calculated using actual velocities were three to four orders of magnitude lower than the observed values. Second, the inferred pressure gradients were independent of the characteristics of the particular fluid.

Thus the above-calculated pressure gradients cannot be correct, and the assumptions underlying their derivation must be re-examined.

Inertial forces may still be neglected as inconsequential. However, the various body forces represented by g should be included. It was concluded that the body forces represented by g primarily represent not gravitational forces, but rather the resistance of the fluid to imposed orientation. This resistance to orientation causes the pressure gradient necessary to maintain $\dot{\epsilon}$ (which is also affected by the die geometry and the imposed volumetric flow rate). As fluid flows through the die it is transformed from an isotropic liquid (melt or solution) to an oriented liquid, with the degree of orientation being dependent on the flow behavior. The pressure should be directly proportional to the potential function $\Phi$. Since pressure is the driving force, P is proportional to $\rho\,\dot{\epsilon}\,\Phi$, and may be expressed as:

$$P=A\Phi+B$$

where in Cartesian coordinates $$A = \frac{2P_o}{\dot{\epsilon}(x_o^2 - x_e^2 + L^2)} \text{ and } B = \frac{P_o(L^2 - x_e^2)}{\dot{\epsilon}(x_o^2 - x_e^2 + L^2)},$$

and in cylindrical coordinates $$A = \frac{2P_o}{\dot{\epsilon}\left(\frac{r_o^2}{2} - \frac{r_e^2}{2} + L^2\right)} \text{ and } B = \frac{P_o\left(L^2 - \frac{r_e^2}{2}\right)}{\dot{\epsilon}\left(\frac{r_o^2}{2} - \frac{r_e^2}{2} + L^2\right)}.$$

The variables $r_o$ and $r_e$ denote the entrance and exit radius values, respectively; $x_o$ and $x_e$ denote the corresponding half slit heights; and L denotes the centerline length of the die.

The stress term in the energy balance equation is $$\tau : \nabla v = \frac{3}{2}\tau_{zz}\dot{\epsilon}$$

for cylindrical coordinates, and for Cartesian coordinates is $\tau:\nabla v=2\tau_{zz}\dot{\epsilon}$.

Under the above assumptions the other two possibly non-zero terms in the energy balance are $$\rho\frac{D}{Dt}(\hat{H}) \text{ and } \frac{DP}{Dt}.$$

With the steady flow assumption these terms become $v\cdot\nabla\ \hat{H}$ and $v\cdot\nabla\ P$. In cylindrical coordinates, $$v \cdot \nabla P = v_r \frac{\partial P}{\partial r} + v_z \frac{\partial P}{\partial z}.$$

The effect of these relations may be found by realizing that P is directly proportional to $\Phi$, and integrating from r=0 to $r_i$ (where $r_i$ is the value of r at the interface either between the polymer and the die wall in skinless flow, or between the polymer and the skin in lubricated flow; $r_i$ is a function of z, although r is not a function of z), and then integrating from z=0 to L. The first term is proportional to $r_e^2$, and the second term is proportional to $L^2$. (The first term is negligible, as it is three orders of magnitude smaller than the second). The same result is obtained in Cartesian coordinates. In cylindrical coordinates $$v \cdot \nabla \hat{H} = v_r \frac{\partial \hat{H}}{\partial r} + v_z \frac{\partial \hat{H}}{\partial z}.$$

By doing a similar double integration it follows that the value of $v_r$ is two orders of magnitude smaller than $v_z$. Furthermore, $$\frac{\partial \hat{H}}{\partial r}$$

is significantly smaller than $$\frac{\partial \hat{H}}{\partial z}$$

because these terms are related to the temperature gradients and the phase change gradients. The die temperature is maintained at the melt temperature, and the melt exits the die into a lower temperature region. Therefore, the temperature gradient in the transverse direction is small, and (at least near the exit of the die) a larger gradient can occur in the longitudinal direction. Furthermore, the phase change occurs progressively in the longitudinal direction due to flow-induced orientation in that direction. Therefore, the enthalpy gradient in the transverse direction should be small, probably much smaller than the enthalpy gradient in the longitudinal direction. The same results are obtained for the pressure and enthalpy terms in Cartesian coordinates. With these simplifications, the energy balance expressed in terms of enthalpy can be integrated from the entrance to the exit, recognizing that the Hencky strain is $$\epsilon_h = \ln\left(\frac{A_o}{A_{ex}}\right) = \ln\left(\frac{r_o^2}{r_e^2}\right) = \ln\left(\frac{L}{z_o}\right)$$

Therefore the stress component in cylindrical coordinates is $$\tau_{zz} = -\frac{2}{3}\frac{\Delta P}{\epsilon_h} + \frac{2}{3}\frac{\rho \Delta \hat{H}}{\epsilon_h}.$$

In Cartesian coordinates this term is $$\tau_{zz} = -\frac{1}{2}\frac{\Delta P}{\epsilon_h} + \frac{1}{2}\frac{\rho \Delta \hat{H}}{\epsilon_h}.$$

The elongational viscosity term, $\eta_e$, in cylindrical coordinates is:

$$\eta_e = \frac{\tau_{zz} - \tau_{rr}}{\dot{\epsilon}} = \frac{3}{2}\frac{\tau_{zz}}{\dot{\epsilon}}$$

and in Cartesian coordinates is:

$$\eta_e = \frac{\tau_{zz} - \tau_{xx}}{\dot{\epsilon}} = 2\frac{\tau_{zz}}{\dot{\epsilon}}.$$

Note that in both Cartesian and cylindrical coordinates the elongational viscosity is:

$$\begin{aligned}\eta_e &= -\frac{\Delta P}{\dot{\epsilon}\epsilon_h} + \frac{\rho \Delta \hat{H}}{\dot{\epsilon}\epsilon_h} \\ &= -\frac{\Delta P A_{ex} L}{Q\epsilon_h} + \frac{\rho A_{ex} L_\Delta \hat{H}}{Q\epsilon_h} \\ &= -\frac{\Delta P L}{v_o \epsilon_h \exp(\epsilon_h)} + \frac{\rho L_\Delta \hat{H}}{v_o \epsilon_h \exp(\epsilon_h)}\end{aligned}$$

where $A_{ex}$ is the exit area, L is the centerline length of the die, Q is the volumetric flow rate, and $v_o$ is the initial velocity. The enthalpy term in essence represents a phase change (either stable or metastable), which may be progressively induced by the orientation imposed on the polymer melt or solution.

Experimental Results and Analysis of Converging Die Flows

Elongational viscosities and other properties were measured for two test systems, namely polyethylene-lubricated polypropylene, and "skinless" polypropylene, each using two different semi-hyperbolically converging conical dies having Hencky strains, $\epsilon_h$, of 6 and 7, respectively. The force g associated with imposing orientation was sufficiently large that we found, surprisingly, that the presence or absence of a lubricating skin layer was insignificant in determining flow characteristics. Development of a high Trouton ratio—on the order of 100 or more—reflects enthalpic and entropic contributions to developing orientation as the polymer melt or solution was transformed from an isotropic liquid to an oriented and highly non-isotropic liquid, perhaps even to an ordered or liquid crystalline state.

If it is assumed that the enthalpic term in the stress difference equations is included in an effective stress difference, $(\tau_{zz})_{ef}$ (mathematically equivalent to setting the enthalpic term to zero), then the effective elongational viscosity is:

$$\eta_{ef} = -\frac{\Delta P}{\dot{\epsilon}\epsilon_h} = -\frac{A_{ex} L \Delta P}{Q\epsilon_h} = -\frac{L \Delta P}{v_o \epsilon_h \exp(\epsilon_h)}$$

This $\eta_{ef}$ reflects both the elongational deformation and the developing orientation. Therefore, if significant orientation develops in elongational flows, the uncorrected measured elongational viscosity is not a true measure of viscosity, but is still related to $\eta_{ef}$.

To appreciate the contribution of orientation development to entropic effects, the proximity of ambient conditions to a first order transition such as the melting point or a transformation to a liquid crystalline state needs to be considered. Polypropylene measurements were made at 200° C. at pressures of 1.15 MPa (11.5 atm) to 42.6 MPa (426 atm), and at strain rates of 0.02 to 136 $s^{-1}$ in the semi-hyperbolically converging conical dies; and at 6.05 MPa (60.5 atm) to 8.23 MPa (82.3 atm), and at strain rates of 0.1 to 0.4 $s^{-1}$ in the hyperbolically converging slit die. These conditions should be compared with those of transition phenomena. The peak melting point of the same polymer, as measured by differential scanning calorimetry in an isotropic, quiescent melt at atmospheric pressure, was 170° C. The last trace of crystallinity disappeared at 180° C. The dilatometric measured atmospheric melting point has previously been reported to be 174° C. The atmospheric pressure equilibrium melting point, obtained by extrapolating the last trace of crystallinity as a function of crystallization temperature, has previously been reported as 191° C. A dilatometric melting point at 300 atm of 191° C. has previously been reported; with a correction comparable to the difference between the measured and equilibrium melting points at atmospheric pressure, this measurement would correspond to an equilibrium melting point of 208° C. After considering these measured and reported transition temperatures, we conclude that the converging flow measurements were made very close to the equilibrium melting point.

At the equilibrium melting point the free energy change $\Delta F$ between the melt state and an ordered state is zero. $\Delta F=\Delta H-T\Delta S$, where $\Delta H$ is the enthalpy change per unit volume (i.e., $\Delta H=\rho\,\Delta\hat{H}$) and $\Delta S$ is the entropy change per unit volume. Therefore, at the equilibrium melting point $\Delta S_f=\Delta H_f/T_m$, where $\Delta H_f$ is the enthalpy of fusion, $\Delta S_f$ is the entropy of fusion, and $T_m$ is the melting point. The latent heat (enthalpy change) of fusion for polypropylene has been reported as $2.15\times10^8$ J/m$^3$ (1 J/m$^3$=1 N/m$^2$=1 Pa) or 215 MPa ($2.15\times10^3$ atm). Therefore, the measured pressure drops of 1.15 MPa to 31.6 MPa for polypropylene in the converging dies ranged from 0.5% to 19.8% of the mechanical equivalent of the latent heat of fusion. (Enthalpy changes for transitions from isotropic liquid to liquid crystal are typically a fraction of the enthalpy of melting or crystallization, around this order of magnitude.) By assuming that the operating temperature of 200° C. (473° K) was the equilibrium melting point, and that the free energy change was zero, the measured pressure drops correspond to entropy changes of 2.43 kPa/$^{\circ}$K (1 kPa/° K=1 J/(m$^3$−° K)) to 90.0 kPa/° K, compared to 455 kPa/K ° for the melting of polypropylene.

A method of estimating enthalpy and entropy changes due to the development of orientation may be summarized as follows. Equation 1 below defines the actual elongational viscosity, $\eta_e$:

$$\eta_e = -\frac{\Delta P}{\dot{\epsilon}\epsilon_h} + \frac{\rho\Delta\hat{H}}{\dot{\epsilon}\epsilon_h} = -\frac{\Delta P A_{ex} L}{Q\epsilon_h} + \frac{\rho A_{ex} L\Delta\hat{H}}{Q\epsilon_h} = -\frac{\Delta P L}{v_o\epsilon_h\exp(\epsilon_h)} + \frac{\rho L\Delta\hat{H}}{v_o\epsilon_h\exp(\epsilon_h)} \quad (1)$$

Equation 2 below defines an effective viscosity, $\eta_{ef}$, which is calculated from the measured volumetric flow, pressure drop, and die geometry:

$$\eta_{ef} = -\frac{\Delta P}{\dot{\epsilon}\epsilon_h} = -\frac{A_{ex} L\Delta P}{Q\epsilon_h} = -\frac{L\Delta P}{v_o\epsilon_h\exp(\epsilon_h)} \quad (2)$$

Assumptions or approximations made to calculate $\Delta\hat{H}$ and $\Delta S$ from these two equations are the following:

(1) That $(\eta_e/\eta_s)=3$, where $\eta_s$ is the shearing viscosity, (which could be measured in a shearing flow rheometer, e.g., a capillary rheometer with a cylindrical capillary). This ratio, the Trouton ratio, is 3 for a Newtonian fluid. By assuming that the Trouton ratio is 3, one in effect assumes that all non-Newtonian and visco-elastic effects exhibited by the fluid are due to resistance to orientation.

(2) That the fluid is in equilibrium, i.e. $\Delta F=0$. Therefore since $\Delta F=\Delta H-T\Delta S$, it follows that $\Delta S=(\Delta H/T)$, where T is the absolute temperature.

Thus the enthalpy and entropy changes may be estimated as follows:

(a) Measure $\eta_s$ with a shearing flow rheometer (b) Measure $\Delta P$ and Q for a given semi-hyperbolic die (so that L, Q, $A_{ex}$, and $\epsilon_h$ are known)

(c) Assume $(\eta_e/\eta_s)=3$, and calculate $\eta_e$ (Note that if the ratio $\eta_{ef}/\eta_s$ is close to 3 then the final calculated $\Delta H$ and $\Delta S$ will be near zero). This ratio $\eta_{ef}/\eta_s$ is referred to as the (measured) Trouton ratio, $T_R$.

(d) All of the terms in the second form of equation 1 are now known, except $\Delta\hat{H}$.Therefore using this equation, one may calculate $\Delta\hat{H}$.

(e) Multiply the calculated $\Delta\hat{H}$ by $\rho$ to get $\Delta H$.

(f) Calculate $\Delta S$ using assumption (b) and the measured temperature on an absolute scale.

These steps may be simplified to the two relations:

$$\eta_{ef} = -\frac{\Delta P}{\dot{\epsilon}\epsilon_h}$$

$$\Delta H = \dot{\epsilon}\epsilon_h(3\eta_s - \eta_{ef})$$

or $$\Delta H = 3\eta_s\dot{\epsilon}\epsilon_h - \Delta P$$

EXAMPLES

Data from the flow behavior of polypropylene, and of 17% cellulose in an NMMO.$H_2O$ solution, illustrate the calculation of these thermodynamic properties. For polypropylene at 200° C. the enthalpy change for the flow induced transformation to a metastable state ranged from $-0.53\times10^7$ to $-3.85\times10^7$ J/m$^3$, with an increase in magnitude as $\dot{\epsilon}$ increased from 1.1 $s^{-1}$ to 128 $s^{-1}$, and with higher values for $\epsilon_h$=7 than for $\epsilon_h$=6. These values may be compared to the enthalpy of melting for polypropylene, $-2.15\times10^8$ J/m$^3$, which is expected to have a greater magnitude because the solid crystalline state has a much higher degree of organization than does a low order liquid crystalline form. The same trends were noted for the calculated entropy changes for polypropylene, which ranged from $-1.1\times10^4$ to $-8.13\times10^4$ J/(K m$^3$).

The data for the 17% cellulose solution in NMMO.$H_2O$ at 95° C. were comparable, with the same trends observed. The enthalpy change for this cellulose solution, corrected for concentration, ranged from $-1.99\times10^7$ to $-4.38\times10^7$ J/m$^3$, with an increase in magnitude as $\dot{\epsilon}$ increased from 34.1 $s^{-1}$ to 94.0 $s^{-1}$, and with higher values for $\epsilon_h$=7 than for $\epsilon_h$=6. The entropy ranged from $-4.49\times10^4$ to $-11.9\times10^4$ J/(K $m^3$). These cellulose values are comparable to results for the same solution measured in a differential scanning calorimeter; the measured enthalpy and calculated entropy changes were $-0.441\times10^6$ to $-4.38\times10^7$ J/$m^3$, and $-1.20\times10^4$ to $-7.19\times10^4$ J/(K $m^3$), respectively.

These measurements demonstrated that, as expected, a higher degree of order was imposed on the polymers by the flow.

The semi-hyperbolically converging dies were used to induce a constant elongational strain rate, and the extrudate was not cooled prior to exiting from the die—both conditions that differ from work previously reported from our laboratory. In polymer melt and solution rheology it has previously been generally assumed that the material starts in an isotropic state, and that this state does not change much during and after flow. It has been discovered that these assumptions may not be justified in many polymer processing operations. The entropic and enthalpic changes noted above are indicative of orientation development. The effective elongational viscosity, measured at the processing elongational strain rates, suggests that similar orientation may develop unrecognized in many other polymer processing operations, but (depending on conditions) the orientation may fully or partially relax prior to solidification as extrudates swell after exiting a confined flow region. Thus the effective elongational viscosity may be a useful measurement of the behavior of polymer melts in processes whose elongational flow field is less well-defined, and also in those having some elongational flow in a mixed flow field. Therefore, even though the measured value of the effective elongational viscosity is not a pure rheological property, it is useful in evaluating related processing behavior and resulting effects, including for example orientation development, swelling, residual stress, and crystallization behavior.

Lyocell Experimental Results

The lyocell solutions had relatively high effective elongational viscosities, probably due to the influence of the entropic contribution. The effective elongational viscosities exhibited local maxima in the range of 85 to 95° C., suggesting that a phase transition occurred in the solutions. This transition may be dependent upon strain rate, $\dot{\epsilon}$, and the Hencky strain, $\epsilon_h$. The inferred phase transition is consistent with previously reported observations that lyocell solutions have a liquid crystalline state below this temperature range, and then gradually transform to an isotropic melt over this temperature range. A liquid crystalline form would produce a large orientation effect, particularly when subjected to elongational flow. Furthermore, the temperature range over which a liquid crystal is observed is extended to higher temperatures when order is imposed on the fluid. Scanning electron micrographs of the extrudates confirmed orientation in the direction of the fiber axis. Furthermore, the electron micrographs indicated that the lyocell solutions separated into small microfibers following extrusion. For example, with an $\epsilon_h$=7 semi-hyperbolically converging conical die with an exit diameter of 600 $\mu$m, the extrudates had diameters around 100 $\mu$m. The micrographs showed that the extrudates had two levels of fine structure. (Both the $\epsilon_h$=6 and the $\epsilon_h$=7 dies used had entrance diameters of 20 mm.) Sugar cane bagasse-derived extrudates had well defined fibrils with a diameter of 10 $\mu$m, and indicated a finer sub-structure yet. This finer sub-structure was also apparent in a micrograph of a wood pulp sample that had been subjected to limited mechanical action. The mechanical action caused some 10 $\mu$m fibrils to be separated from the rest of the extrudate; and these fibrils exhibited still smaller fibrils having a diameter of 0.5 $\mu$m, well below the 2 $\mu$m limit for microfibers. In fact, the microfibers with a diameter of 0.5 $\mu$m could even be classified as "ultrafibers."

The result of this process is an extrudate having two distinct levels of organization, both oriented in the direction of flow. On the larger scale, the extrudate comprises distinct filaments, each filament having a diameter on the order of 10 $\mu$m, aligned with one another in the flow direction. Each filament has a substructure: each is a bundle of microfibers with a diameter on the order of 0.5 $\mu$m. We have separated the 10 $\mu$m diameter filaments from one another by simple mechanical action (e.g., breaking the extrudate with a tensile load). It is preferred, however, to separate the 10 $\mu$m filaments from one another, and the 0.5 $\mu$m microfibers from one another in a more controlled manner.

For example, the extrudates may be first formed into yarns or even into fabrics prior to the separation process. The separation may use a combination of chemical and mechanical action, or either chemical or mechanical action separately, to remove retained solvent and thereby separate the substructures from one another. For example, a yarn could be either simultaneously or sequentially subjected to a transverse rolling action and treatment with hot water or other suitable solvent to remove the retained lyocell solvent. It may be desirable in some applications to conduct such treatment in a number of steps to more effectively tease the substructures apart, and it may be desirable for different applications to have different levels of separation. For example, cleaning cloths may be produced for different applications. A cloth used to clean automobile exteriors may not need a high degree of separation, and may benefit from a range of separations; whereas a cloth for cleaning microchips might need as high a degree of separation as possible.

It will usually be preferred to keep the microfibers organized in their extrudate form during subsequent processing into yarns and fabrics, because their small diameter makes them susceptible to failure if they separate due to minor load shifting within a bundle. If micro-machined converging dies are used (e.g., dies made by a LIGA or modified LIGA process with a 2 $\mu$m exit diameter in a spinneret to form 0.5 $\mu$m diameter microfibers, or larger diameter holes for larger diameter bundles of microfibers), it will probably be necessary to form the filaments thus produced into yarns prior to mechanical or chemical treatment since the filaments will have such small diameters. Use of a micromachined die may force the extruded filaments to have even smaller microstructures if sufficiently small openings are used. If the material is formed into a fabric prior to separation of the microfibers, the mechanical action should probably be in at least two directions due to the two-dimensional character of a fabric.

Microfibers in accordance with this invention are preferably at least 1.0 cm long, and may be 2.5 cm, 5.0 cm long or even longer. However, these fibers may also be substantially shorter, because the microfibers may be converted to yarn prior to separating the microfibers from each other. Once formed into yarns or fabrics the lower limit on the length of the microfibers depends primarily upon the need to maintain the integrity of the yarn. Maintenance of yarn integrity in turn depends primarily upon the fiber stiffness, and the length to diameter ratio. With microfibers having a diameter of 0.5 $\mu$m or smaller, the critical length for yarn integrity is on the order of one to a few mm.

Adding another component to the lyocell solution, e.g. lignin, may allow easier separation of microfibers from each other by dissolving lignin when desired.

The complete disclosures of all references cited in this specification are hereby incorporated by reference. Also incorporated by reference is the complete disclosure of John R. Collier, "Elongational Rheometer and On-Line Process Controller," commonly-owned patent application Ser. No. 09/172,056, filed Oct. 14, 1998.

We claim:

1. A process for manufacturing cellulosic microfibers of diameter 10 $\mu$m or less, comprising the steps of:

(a) preparing a lyotropic liquid crystalline solution of cellulose in a solvent;

(b) flowing the solution through a converging die to apply stress to the solution such that the solution separates into two phases: one phase containing primarily oriented cellulosic microfibers of diameter 10 $\mu$m or less and relatively little solvent, and one phase containing primarily solvent and relatively little cellulose.

2. A process as recited in claim 1, additionally comprising the step of removing the solvent-rich phase by chemical action, mechanical action, or both chemical action and mechanical action.

3. A process as recited in claim 2, additionally comprising the step of separating microfibers from one another by mechanical action.

4. A process for manufacturing a yarn comprising cellulosic microfibers of diameter 0.5 $\mu$m or less, comprising the steps of:

(a) preparing a lyotropic liquid crystalline solution of cellulose in a solvent;

(b) flowing the solution through an array of converging dies to apply stress to the solution such that the solution in each die separates into two phases: one phase containing primarily oriented cellulosic microfibers of diameter 0.5 $\mu$m or less and relatively little solvent, and one phase containing primarily solvent and relatively little cellulose;

(c) combining the microfibers exiting the converging dies into a yarn.

5. A process as recited in claim 4, additionally comprising the step of removing the solvent-rich phase by chemical action, mechanical action, or both chemical action and mechanical action.

* * * * *